US005868489A

United States Patent [19]

Fuller et al.

[11] Patent Number: 5,868,489

[45] Date of Patent: Feb. 9, 1999

[54] TRANSPARENT ELECTRICAL FIXTURE

[76] Inventors: Robert J. Fuller; Ronald T. Fuller, both of 5400 N. Dixie Hwy., Suite 3, Boca Raton, Fla. 33487

[21] Appl. No.: 807,715

[22] Filed: Feb. 28, 1997

[51] Int. Cl.[6] ..... F21V 21/14

[52] U.S. Cl. ..... 362/249; 362/311; 362/806; 362/404; 362/147

[58] Field of Search ..... 362/249, 311, 362/351, 147, 404, 806

[56] References Cited

U.S. PATENT DOCUMENTS

| | | | |
|---|---|---|---|
| 4,118,760 | 10/1978 | Cohon | 362/239 |
| 4,688,154 | 8/1987 | Nilssen | 362/147 |
| 4,967,327 | 10/1990 | Thurlow | 362/249 |
| 5,203,626 | 4/1993 | Clement | 362/250 |
| 5,455,754 | 10/1995 | Hoffner | 362/250 |

*Primary Examiner*—Thomas M. Sember
*Attorney, Agent, or Firm*—Robert M. Downey, P.A.

[57] ABSTRACT

An electrical fixture assembly includes three transparent acrylic panels including first and second panels disposed in spaced, parallel relation to one another and each being attached to opposite edges of a third panel extending perpendicularly between the first and second panels to define an I-beam. Vertically extending support rods pivotally attach at one end to brackets on the top of the second panel and to mounting brackets on a ceiling or other overhead structure at an opposite end. Conductors leading from an external power source extend along the support rods, down opposite ends of the I-beam, and interconnect to electrical devices attached on the bottom surface of the first panel to supply electric power thereto.

18 Claims, 2 Drawing Sheets

TRANSPARENT ELECTRICAL FIXTURE

BACKGROUND OF THE INVENTION

1. Field of the Invention

The present invention relates to electrical fixtures and, more specifically, to an electrical fixture comprising at least two transparent panels formed of a rigid transparent material, wherein one of the panels includes a plurality of electrical devices attached thereto and interconnected to an external electric power source.

2. Description of the Related Art

The art is crowded with numerous electrical fixtures adapted for mounting to walls or ceilings. In most cases, the fixture is intended to be highly visible and have an attractive, ornamental appearance. Examples of such fixtures are ceiling fans, chandeliers, wall sconces, and lamps, all of which are artistically shaped and configured to provide a highly visible aesthetic appearance.

In spite of the many lighting fixtures and other electrical fixtures in the field, there still exists a need in the industry for a transparent structure which is adapted to support electrical devices such as lights, speakers, and the like in such a manner so that the fixture is not visible, thus presenting the illusion that the devices are floating in mid-air.

SUMMARY OF THE INVENTION

The present invention is directed to an electrical fixture assembly, and more specifically to a beam formed of a clear acrylic material, such as lucite, which is supported from a ceiling or overhead structure. The beam is preferably in the configuration of an I-beam or T-beam and includes at least one panel on which a plurality of light fixtures, audio speakers, or other electrical devices are mounted in spaced relation along a length thereof. The lighting fixtures are preferably of a low voltage (12 volts) type which can be powered by an external electric power source. In a preferred embodiment, lighting fixtures such as MRIG lamps which plug into ceramic sockets mounted to the bottom panel of the beam, so that the lamps are clearly visible but not the transparent beam.

The electrical devices supported on the beam are interconnected with an external power source by lead conductors which extend down support rods and sides of the beam and along the bottom panel. In a preferred embodiment, 16 gauge or 18 gauge copper silver tend busswire is used to provide power to the low voltage electrical devices.

The beam is supported from the ceiling or overhead structure on lucite tubes which are disposed in spaced relation at opposite ends of the beam, pivotally connecting at opposite ends to the beam and ceiling or overhead structure, respectively.

OBJECTS AND ADVANTAGES OF THE INVENTION

It is a primary object of the present invention to provide an electrical fixture assembly which is structured to be supported from a ceiling or overhead structure and including a plurality of electrical devices such as lights, speakers and the like, and wherein the fixture is transparent so that it is not easily visible.

It is a further object of the present invention to provide a transparent electrical fixture for supporting electrical devices such as lights, speakers and the like in a manner so that the fixture is not visible, thus presenting the illusion that the electrical devices are floating in mid-air.

It is still a further object of the present invention to provide an electrical fixture assembly for supporting a plurality of electrical devices in spaced relation from a ceiling or other overhead structure in an aesthetically pleasing manner.

It is still a further object of the present invention to provide an electrical fixture formed of a transparent material which is structured to support a plurality of electrical devices, and wherein the electrical fixture assembly is relatively inexpensive and easy to install.

It is still a further object of the present invention to provide an electrical fixture assembly, as set forth above, which is adapted for mounting to angled surfaces of varying degrees and wherein the assembly includes pivoting means so that the fixture assumes a preferred orientation when supported from an angled mounting surface.

These and other objects and advantages of the present invention will be more readily apparent in the description which follows with reference to the accompanying drawings.

BRIEF DESCRIPTION OF THE DRAWINGS

For a fuller understanding of the nature of the present invention, reference should be had to the following description taken in connection with the accompanying drawings in which.

Like reference numerals refer to like parts throughout the several views of the drawings.

DETAILED DESCRIPTION OF THE PREFERRED EMBODIMENT

Figures 1, 4:
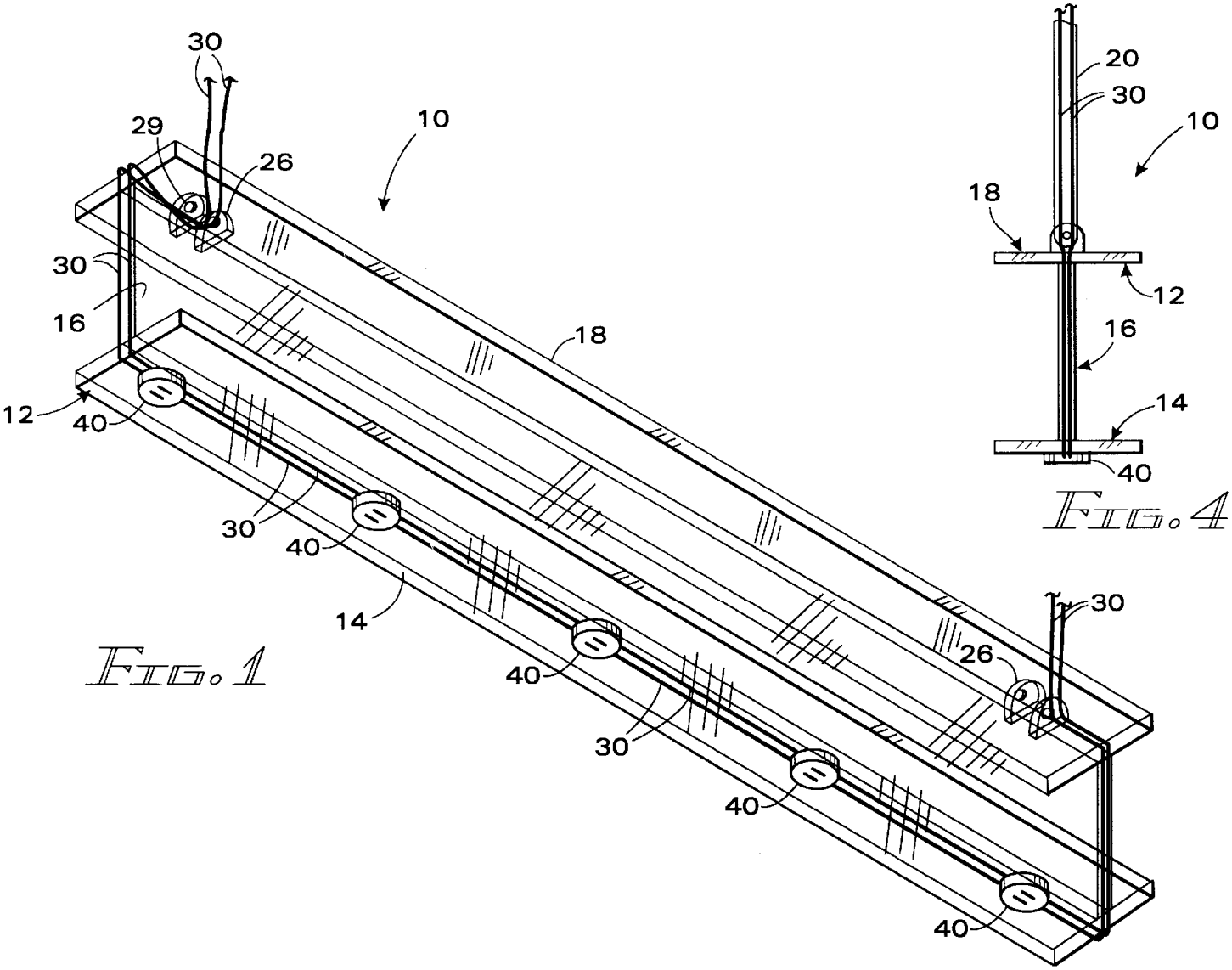
FIG. 1 is a perspective view of the electrical fixture assembly of the present invention.
FIG. 4 is an end elevational view thereof.
Figure 2:
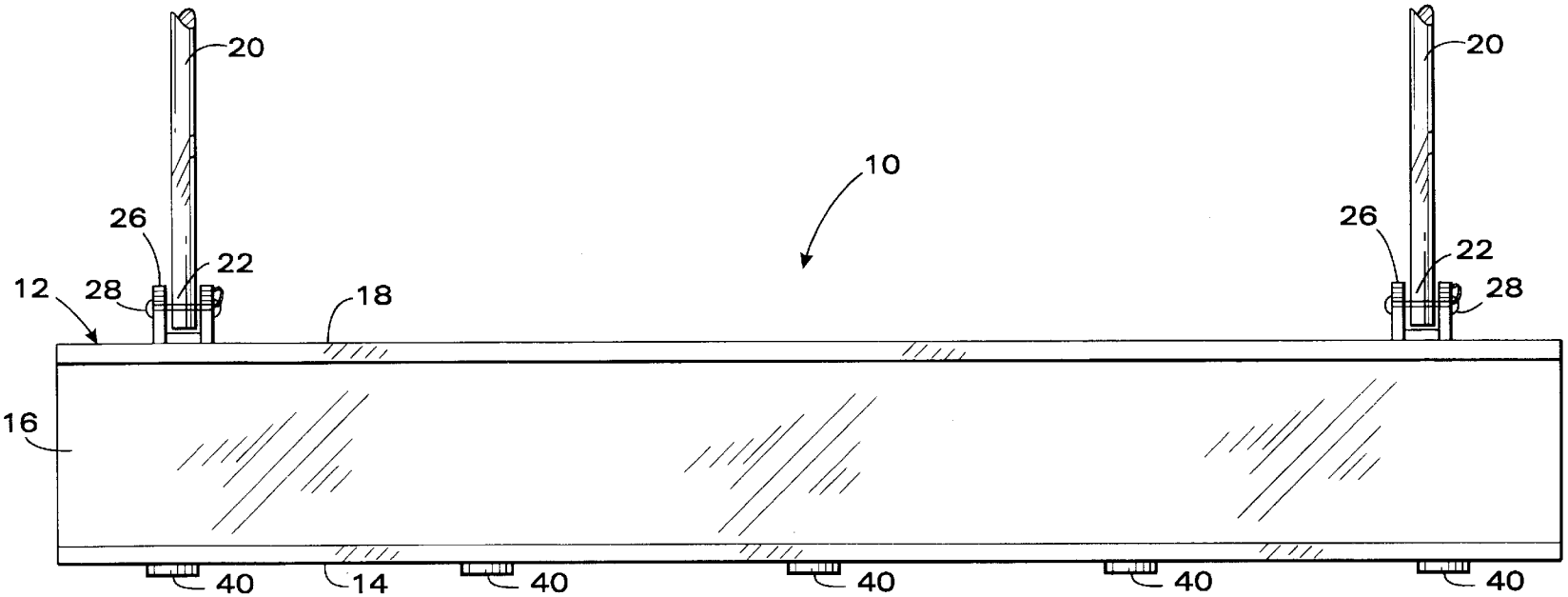
FIG. 2 is a front elevational view thereof.
Figure 3:
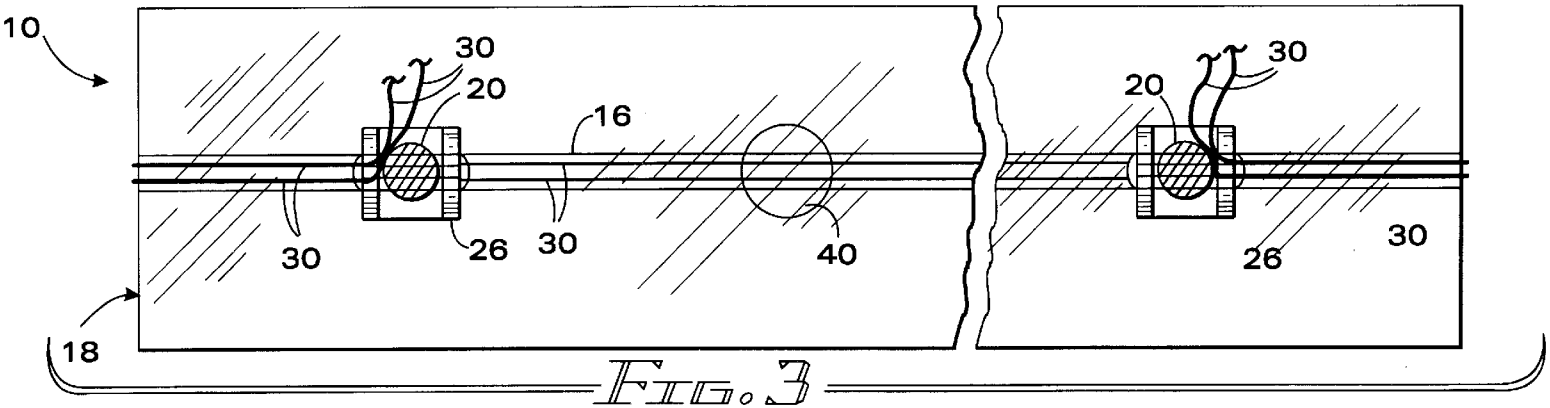
FIG. 3 is a top plan view thereof.

Referring to the several views of the drawings, there is illustrated the electrical fixture assembly generally indicated as 10. The fixture assembly 10 is defined primarily by a beam structure 12 formed of transparent acrylic panels including at least a first base panel 14 and a support panel 16 attached to the base panel 14 in perpendicular relation thereto. In a preferred embodiment, the beam structure is structured as an I-beam and includes the base panel 14, intermediate support panel 16, and a top panel 18 disposed in spaced, parallel relation to the base panel 14 and attached perpendicularly to a top edge of the intermediate panel 16 opposite the lower base panel 14.

Transparent beam structure 12 is supported from a ceiling or other overhead structure by vertically extending support rods 20, preferably formed of ⅜" diameter acrylic rods. The support rods 20 pivotally attach at a lower distal end 22 to U-shaped brackets 26 with cotter pins 28 or like pin elements which pass through apertures 29 formed through the opposite vertical members of the U-shaped brackets 26 and aligned apertures formed through the distal ends 22 of each of the respective support rods 20. Similar U-shaped brackets are fitted to the opposite ends of the support rods 20 (not shown) to mount the fixture assembly 10 to a ceiling surface or other overhead structure surface.

Conductors 30 are lead from an external power source (not shown) and extend down the support rods 20, down opposite sides of the beam structure 12, and along the bottom surface of the base panel 14 for interconnection in series with a plurality of electrical devices 40 mounted to the bottom surface of the base panel 14 at spaced intervals therealong. The electrical devices 40 are preferably of a low voltage type (12 volts) and thus the conductors 30 need only be of a 16 or 18 gauge copper silver tend busswire. The electrical devices 40 can be ceramic sockets or like fittings for electrical interconnection with lamps. Alternatively, the electrical devices may be miniature light assemblies, audio speakers, or other like low voltage devices.

In accordance with the preferred embodiment, the pivotal attachment of the support rods 20 to the U-shaped brackets enables the fixture assembly 10 to be mounted to either a horizontal ceiling surface or, alternatively, to a sloped or angled surface such as a cathedral ceiling, with the support rods remaining vertical so that the beam structure 12 is supported in a horizontal orientation with the electrical devices 40 facing downward. The structural nature and transparent acrylic material hides the supporting beam structure 12 and support rods 20 from normal view, especially in dim-lighted conditions, so that only the electrical devices 40 are clearly visible.

While the instant invention has been shown and described in what is considered to be a preferred and practical embodiment thereof, it is recognized that departures may be made within the spirit and scope of the invention which is, therefore, not to be limited except as set forth within the following claims and under the doctrine of equivalents.

Now that the invention has been described,

What is claimed is:

1. An electrical fixture assembly attachable to a mounting surface and comprising:

a base including a first transparent, elongate panel having a top face, a bottom face, a front edge, a rear edge, and opposite ends, a plurality of electrical devices mounted to said bottom face of said first panel at spaced intervals between said opposite ends, electrical conductor means for delivering electric current flow to said plurality of electrical devices, and mounting means for supporting said first panel in spaced relation from the mounting surface.

2. An assembly as recited in claim 1 wherein said base further includes a second transparent, elongate panel disposed in spaced, parallel relation to said first panel.

3. An assembly as recited in claim 2 wherein said base further includes a third transparent, elongate panel attached to said first and second panels and extending transversely therebetween in perpendicular relation to said first and second panels to thereby provide an I-beam structural configuration to said base.

4. An assembly as recited in claim 3 wherein said electrical conductor means includes wire conductors fitted to said base and interconnecting to each of said plurality of electrical devices.

5. An assembly as recited in claim 1 wherein said mounting means includes at least one elongate rod having a first end fitted to the mounting surface and an opposite second end fitted to said base.

6. An assembly as recited in claim 5 wherein said second end of said elongate rod is pivotally fitted to said base to permit pivoting movement of said base relative to the mounting surface and said elongate rod.

7. An assembly as recited in claim 6 wherein said elongate rod is formed of a transparent material.

8. An assembly as recited in claim 7 wherein said mounting means includes a plurality of said elongate rods.

9. An assembly as recited in claim 1 wherein said plurality of electrical devices include lighting fixtures.

10. An assembly as recited in claim 1 wherein said plurality of electrical devices include electrical sockets.

11. An assembly as recited in claim 1 wherein said plurality of electrical devices include low voltage miniature light assemblies.

12. An electrical fixture assembly attachable to a mounting surface and comprising:

a base including a first transparent, elongate panel having a top face, a bottom face, a front edge, a rear edge, and opposite ends, a plurality of electrical devices mounted to said bottom face of said first panel at spaced intervals between said opposite ends, electrical conductor means for delivering electric current flow to said plurality of electrical devices, and mounting means for supporting said first panel in spaced relation from the mounting surface and including at least one elongate rod formed of a transparent material and including a first end fitted to the mounting surface and an opposite second end pivotally fitted to said base to permit pivoting movement of said base relative to the mounting surface and said elongate rod.

13. An assembly as recited in claim 12 wherein said base further includes a second transparent, elongate panel disposed in spaced, parallel relation to said first panel.

14. An assembly as recited in claim 13 wherein said base further includes a third transparent, elongate panel attached to said first and second panels and extending transversely therebetween in perpendicular relation to said first and second panels to thereby provide an I-beam structural configuration to said base.

15. An assembly as recited in claim 14 wherein said electrical conductor means includes wire conductors fitted to said base and interconnecting to each of said plurality of electrical devices.

16. An assembly as recited in claim 12 wherein said plurality of electrical devices include lighting fixtures.

17. An assembly as recited in claim 12 wherein said plurality of electrical devices include electrical sockets.

18. An assembly as recited in claim 12 wherein said plurality of electrical devices include low voltage miniature light assemblies.

* * * * *